US006746292B2

(12) United States Patent
Panzer

(10) Patent No.: US 6,746,292 B2
(45) Date of Patent: Jun. 8, 2004

(54) BOTTOM FIN FOR A WATERSPORTS BOARD

(76) Inventor: David G. Panzer, P.O. Box 3330464, Kahului, HI (US) 96733

( * ) Notice: Subject to any disclaimer, the term of this patent is extended or adjusted under 35 U.S.C. 154(b) by 135 days.

(21) Appl. No.: 10/267,088

(22) Filed: Oct. 9, 2002

(65) Prior Publication Data

US 2004/0072483 A1 Apr. 15, 2004

(51) Int. Cl.[7] ..... B63B 1/00
(52) U.S. Cl. ..... 441/79; 114/39.15
(58) Field of Search ..... 114/39.15, 127, 114/140; 441/79

(56) References Cited

U.S. PATENT DOCUMENTS 3,422,471 A * 1/1969 Morey et al. ..... 441/74
3,516,099 A * 6/1970 Morey et al. ..... 441/79

FOREIGN PATENT DOCUMENTS

GB 2136739 * 9/1984 ..... 114/140

* cited by examiner

*Primary Examiner*—Stephen Avila
(74) *Attorney, Agent, or Firm*—Charles C. Logan, II

(57) ABSTRACT

A bottom fin for a watersports board such as a surfboard or a windsurfer board. It has an upper body portion having a leading edge that extends downwardly and rearwardly from its front end. The bottom fin also has a lower body portion having a leading edge that extends downwardly and forwardly from the bottom end of the leading edge of the upper body portion. The upper body portion and lower body portion have a trailing edge that extends downwardly from the rear end of the top edge of the bottom fin all the way down to its bottom end. An elongated bulbous member is connected to the bottom end of the fin. There are attachment lugs extending upwardly from the top end of the bottom fin for securing the fin to the bottom surface of a watersports board.

17 Claims, 5 Drawing Sheets

Fig. 4-A

BOTTOM FIN FOR A WATERSPORTS BOARD

BACKGROUND OF THE INVENTION

The invention relates to an aerodynamically shaped fin and more specifically to a fin that would be attached to the bottom surface of watersports boards such as surfboards and windsurfers.

Conventional surfboard fins have a leading edge and a trailing edge. The top end of the leading edge slopes downwardly and rearwardly. The top end of the trailing edge slopes downwardly and normally ends at a point rearwardly with respect to the top end of the trailing edge. One example of such a surfboard is illustrated in the Knox U.S. design Pat. No. D261,916. The leading edge has a convex curvature extending from its top end to its rear end. The trailing edge has a concave upper portion extending from its rear end that reverse tp form a convex curved portion extending downwardly therefrom to the bottom end of the leading edge.

The Struyik U.S. design Pat. No. D329,039 discloses a personal watercraft fin that incorporates a Pitot tube. It has a leading edge that extends downwardly and rearwardly from its top end in a concave curvature that leaves its bottom end positioned rearwardly with respect to its top end.

The Akins U.S. design Pat. No. D397,394 is directed to curved side fins for a surfboard. Each of the fins has a leading edge that extends downwardly from its front end in a convex curvature. The fins have a trailing edge that extends downwardly from their top end in a concave curvature. The fins also have a transverse curvature as best illustrated in FIG. 1.

The Kelly U.S. Pat. No. 3,160,897 is directed to a hydroplane surfboard. It has a fin having a front end that extends downwardly and rearwardly in a convex curvature. It has a trailing edge that extends downwardly from its top end in a concave curvature and ultimately meets the bottom of the leading edge. The Bahne Jr. U.S. Pat. No. 3,564,632 and the Brewer et al U.S. Pat. No. 4,044,416 illustrate adjustable surfboard fin holders. The fins illustrated in these patents each have a leading edge that extends downwardly from their top end in a convex curvature. Their trailing edge also extends downwardly from their top end in a concave curvature.

The Collum, Jr. U.S. Pat. No. 4,325,154 and the Lewis U.S. Pat. No. 5,480,331 illustrate surfboard fins that have a leading edge that extends downwardly from their top ends in a convex curvature to their bottom ends. They also have a trailing edge that extends downwardly from their top ends in a concave curvature.

The Fizzell U.S. Pat. No. 5,934,963 and the Block et al U.S. Pat. No. 5,997,376 disclose surfboard fin mounting structures. The fins disclosed each has a leading edge that extends downwardly in a convex curvature. Their trailing edge extends downwardly from their top end in a concave curvature.

The Vogel U.S. Pat. No. 6,059,621 discloses a high performance surfboard having three fins mounted adjacently its rear end. Each of these fins has a leading edge that extends downwardly from its top end in a convex curvature. Their trailing edge extends downwardly from their top end in a concave curvature.

It is an object of the invention to provide a novel bottom fin for a surfboard that reduces vibration and drag when the board rider puts the surfboard into a hard turn and helps the board rider to get through a corner quicker.

It is also an object of the invention to provide a novel bottom fin for a surfboard that provides greater stability on the face of a wave.

It is a further object of the invention to provide a novel bottom fin for a surfboard that is strong yet lightweight.

It is also another object of the invention to provide a novel bottom fin for a surfboard that is economical to manufacture and market.

It is also an object of the invention to provide a novel bottom fin for a windsurfer that provides greater stability on the face of a wave

SUMMARY OF THE INVENTION

The novel fin is designed for use with both surfboards and windsurfer boards although with minor design differences that are specific to each. The fin would be made in various sizes, proportionate to match the specific size/weight of the individual riders and length/type of board. Surfboards also often have two smaller fins, one placed on either side of, and forward of the larger central fin and fairly close to the outer edges of the board. The new fin design is derived from two fundamental engineering principals.

Principal No. 1

The forward swept angle of the fin is derived from an airplane wing design that dates prior to World War II. At that time some gliders were built with forward swept wings and the NACA Langley Memorial Aeronautical Laboratory had done some wind tunnel experiments on the concept in 1931. Also, Germany developed a motor driven aircraft during the war known as the Ju-287. Between 1984 and 1992, NASA conducted tests of this design using two experimental aircraft known as the X-29. The effect of this design is to cause air moving over the forward swept wings to flow inward toward the root of the wing instead of outwards toward the wing tip as occurs on a conventionally aft swept wing. This reverse air flow considerably retards the onset as stall (at high angles of attack) at the wing tips and ailerons, something that happens much more readily with a conventional design.

Principal No. 2

The second principal that is combined with the forward swept angle is derived from the "bulbous bow" design that is almost always found on large ocean going vessels, whether it is a warship or a commercial vessel. The purpose of the design is to reduce the number of pressure waves caused by a vessel as it moves through the water, thus reducing the amount of resistance, which results in less drag, higher speeds and lower fuel costs. This same principal can be seen in modern submarine design that dates back to the USS Albacore, built during the early 1950's. This new "tear drop" design was a radical departure from all previous designs before it and allowed much faster speeds, and improved maneuvering, under water.

Current surfboard and windsurfer boards have fins having a wide range of designs, ranging from those that use a straight leading edge and/or trailing edge to those that are sharply curved, depending on the type of sailing or racing intended. Essentially, they parallel the principals of conventional airplane wing design in that, to one degree or another, they are all swept back. The one aspect more or less common to them all is that, in the same manner as wind passing over conventional airplane wings, they tend to direct water flow toward the tip of the fin. When the board is put into a hard turn, the water flow turbulence off the end of the fin causes a vibration, or flutter, and drag. The design of the novel fin will reduce that flutter/drag and help the board rider get through a corner quicker. It will also reduce drag when the rider is traveling in a straight line.

The basic shape for the improved fin design is the same regardless of which type of board it's intended for, however, the version intended for use on a surfboard has a slight teardrop design incorporated into the bottom of the fin. It is also intended to make versions available without the teardrop shape for those who prefer not to have it.

The design for the windsurfer board does not have the full teardrop shape, only a bulbous shape at the front bottom end which is more or less flush with, but no wider than, the widest point of the main fin body at the bottom where it joins. The reason for the difference lies in the different types of actions inherent to each board types purpose.

Although the surfboard is intended to go across and down, or up the face of a wave, it nevertheless travels in more or less a stable plane of depth with regard to the fin's movement through the water. It's this relative stability that allows the teardrop design to help in both reducing drag and in maneuvering.

On the other hand, a windsurfer board is designed to cut across the top of waves and, since the surface of the water is undulating, the same teardrop design that would be beneficial to a surfboard would actually increase drag slightly in the windsurfer application.

As mentioned earlier, the overall shape is common to both types of boards. The first one and a half inches of the leading edge of the fin actually angles back thirty degrees from the perpendicular at which point it changes to thirty degrees forward of perpendicular. The trailing edge is angled forward at a forty-five degree angle. This serves two purposes, one that is functional, and the other having to do with safety.

First, by angling the forward most point of the base area of the fin slightly to the rear, a low-pressure area is created which aids the overall design of the fin in directing water flow over the fin surface toward the base rather than the tip. This raises the threshold for the onset of flutter/vibration/resistance.

The other major reason has to do with safety. If the fin were to be angled all of the way back to the base where it meets the board, a sharp angle would be formed. This would create a natural trap for fingers, hands, arms, legs or other boards that would pose a hazard to the rider or others in the water near the board. By moving the initial point for the forward sweep of the fin and one and a half inches out from the base of the board the angle becomes much less acute and less likely to cause injury.

There are a number of different commercially available ways of securing a fin to surf/windsurfer boards. These range from fiberglassing it in place to fixed place attachments and adjustable ratchet devices that fit into a box installed in the bottom of many surf and windsurfer boards. There are already a number of these "box" devices on the market which allow the fin to be moved a short distance forward or backward along a center line to find the optimal balance point for each individual.

Use of a "box" device to attach a fin will be the most likely method (at least during the early stages of familiarization with the boards characteristics) since the point of balance of each board will be different than it would with a conventional style of a fin. As a result, each rider will have to determine the most advantageous location for him/herself and a fin that's adjustable makes the most sense initially.

During the early stages of development in aeronautical forward wing design, some advantages and disadvantages soon became apparent.

While it was very agile and had a quick response to control input, those same characteristics made it inherently unstable, requiring constant attention and rapid response to maintain control (traits that is not an issue in this application).

Properties more relevant to this application were the aerodynamic forces acting on the wingtips that would cause the wing to torque; a twisting motion that placed great stress on the structure of the wing, inducing metal fatigue and failure. Both forces were so great that the only way to create a wing structure strong enough to resist damage, using the materials available at that time resulted in a wing too heavy to be efficient. That problem wasn't overcome until the advent of carbon fiber materials and other composites which allow great strength and rigidity in very lightweight structures.

Obviously, while similar in nature, the forces causing a tendency to twist or torque that will act on the novel fin will not be as great. Even so, the layout of the fin must be constructed so as to eliminate or at least minimize any twisting or tendency to torque that would shorten the life of the fin (or its attachment mechanism) and cause unnecessary turbulence. With that in mind, although it may not prove necessary, the fiberglass or carbon fiber cloth layers may be laid out at cross angles to the projected lines of stress to create the fin "blank" in such a way as to achieve the necessary rigidity while maintaining an economy of size and weight. Some of the illustrations in the drawings show an approximate angle of twenty degrees that serves only as an example that will be adjusted and optimized once development and manufacturing are underway. The actual shape of the fin can then be most efficiently carved out of that sort of "blank" by an automated milling machine. It should also be noted that since a molding process is likely to be much more cost-effective, that will also be pursued if sufficiently rigidly material can be found.

DESCRIPTION OF THE DRAWINGS

FIG. 4A is a schematic bottom perspective view of a surfboard with center mounted full-size fin and two scaled down "thruster' type versions of the fin mounted one on each side, outboard of the larger center fin.

DESCRIPTION OF THE PREFERRED EMBODIMENT

Figure 1:
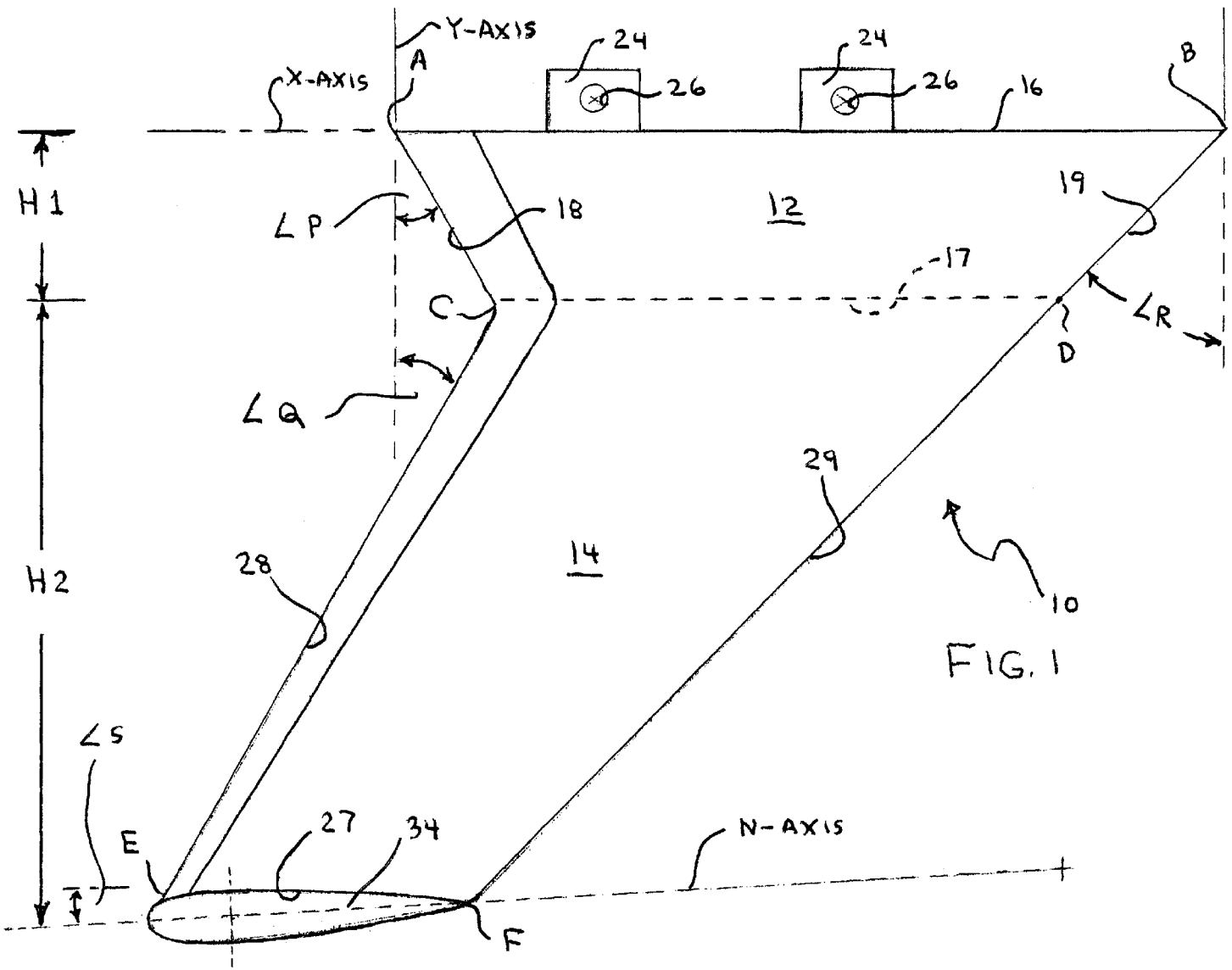
FIG. 1 is a side elevation view of the novel bottom fin with its front end at the left and its rear end at the right.

The novel bottom fin for a watersports board will now be described by referring to FIGS. 1–5 of the drawings. The bottom fin is generally designated numeral 10. It has an upper body portion 12 and a lower body portion 14.

Upper body portion 12 has a top edge 16, a bottom end 17, a leading edge 18 and a trailing edge 19. Top edge 16 has a longitudinally extending X-axis and a front end point A and a rear end point B. Bottom end 17 has a front end point C and a rear end point D. Dotted perpendicular lines are positioned for reference of rearward and forward swept angles. Leading edge 18 extends downwardly and rearwardly at an acute angle P to the vertically oriented Y-axis. Angle P is substantially 30 degrees. Trailing edge 19 extends downwardly and forwardly from a vertically oriented M-axis at an acute angle R that is substantially 45 degrees. A pair of attachment tabs or lugs 24 having recesses 26 formed in their lateral surfaces extend upwardly from top edge 16. The attachment tabs 24 are an example type for illustration only. The tabs shown are manufactured by and known as "Fin Control Systems" (F.C.S.) Type. Top edge 16 has a length L1 that may be in the range of 4–12 inches. Upper body portion 12 has a height H1.

Lower body portion 14 has a top end 26, a bottom end 27, a leading edge 28 and a trailing edge 29. Leading edge 28 extends downwardly and forwardly at an acute angle Q with respect to the Y-axis. Angle Q is substantially 30 degrees. The upper body portion trailing edge 19 and the lower body portion trailing edge 29 have a common axis. Lower body portion 14 has a height H2.

A teardrop-shaped bulbous 34 is connected to the bottom end 27 of lower body portion 14. It has a longitudinally extending N-axis that is oriented downwardly from rear to front at an acute angle S that is substantially 2.5 degrees.

The size of the fin is scalable, up or down, (in order to be matched to the weight or performance characteristics of the Board Rider) and is dictated only by the angles of the leading and trailing edges. In addition, because water conditions will vary due to the weather or wave height conditions, it will also be necessary to construct fins with Leading and Trailing Edge angles similar to but different from those indicated above.

Figure 2:
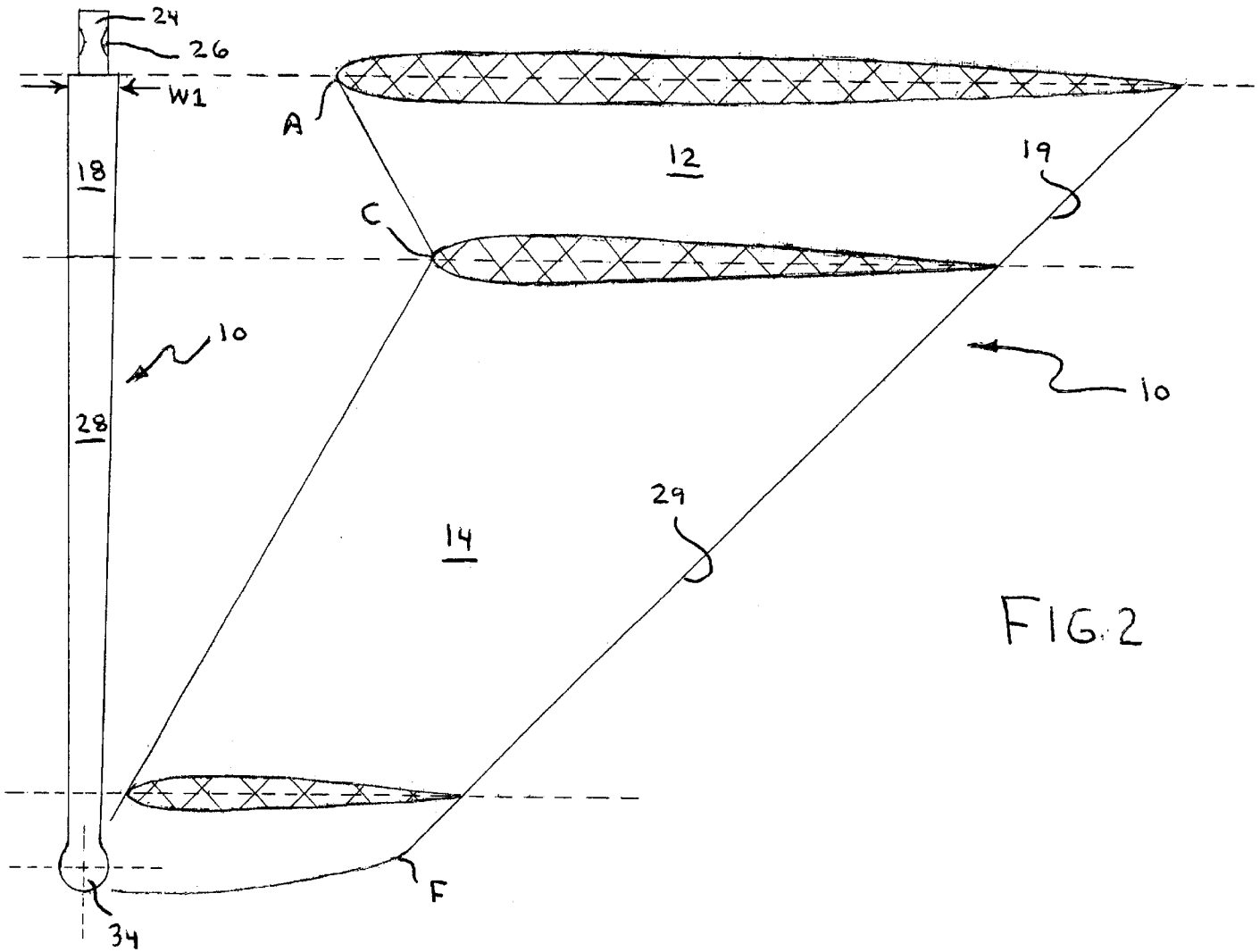
FIG. 2 is a schematic combination front and side view with 3 separate cross-sections that show the thickness at the top, at the location of the leading edge angle change, and near the bottom of the junction with the 'teardrop' shape. The purpose of these views are to show how the fin is thickest at the top and thinner towards the bottom. Production fins will vary in thickness according to the strength and rigidity of the material used.
Figure 3:
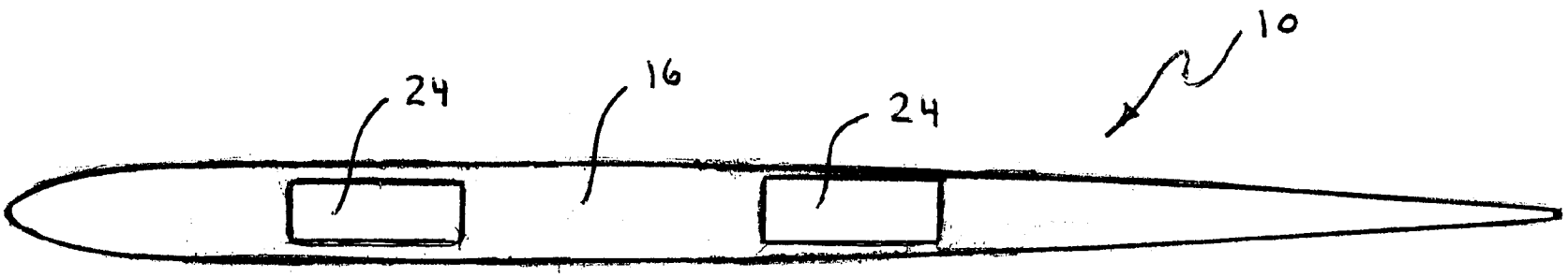
FIG. 3 is a top view sample F.C.S. attachment tabs.
Figure 4:
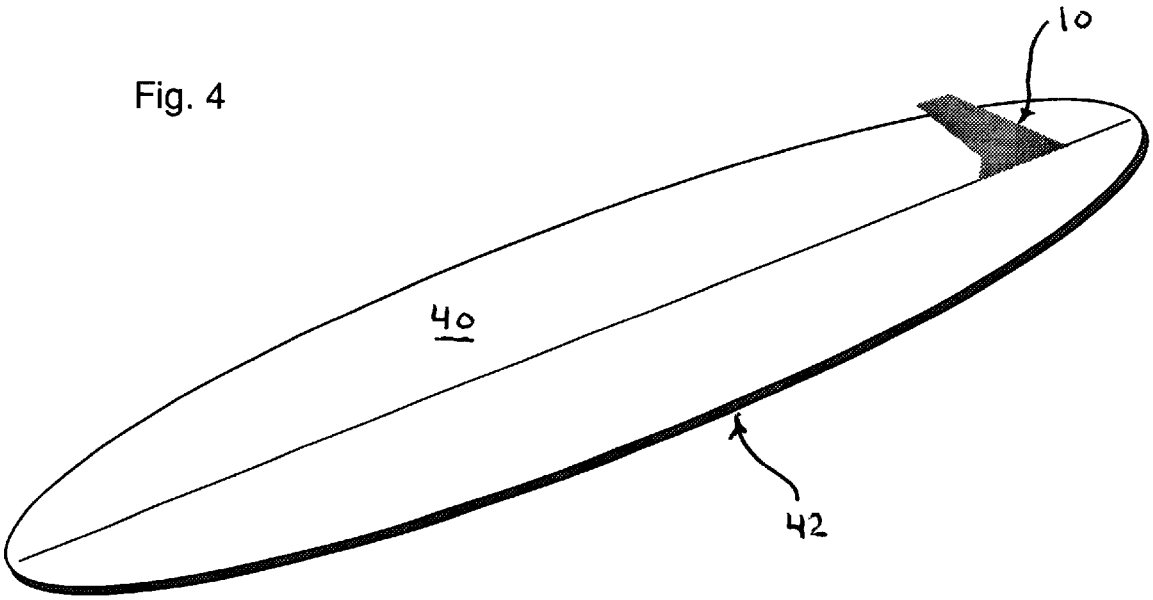
FIG. 4 is a schematic bottom perspective view of either a surf or windsurf board with center mounted full size fin (Not shown to scale)
Figure 4:
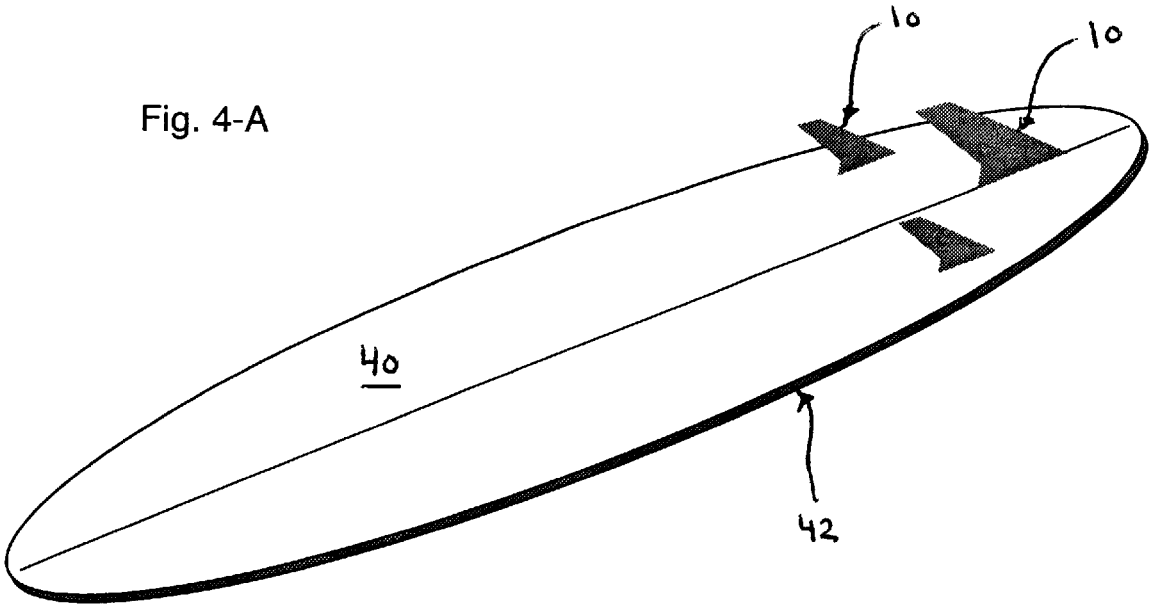
Figure 5:
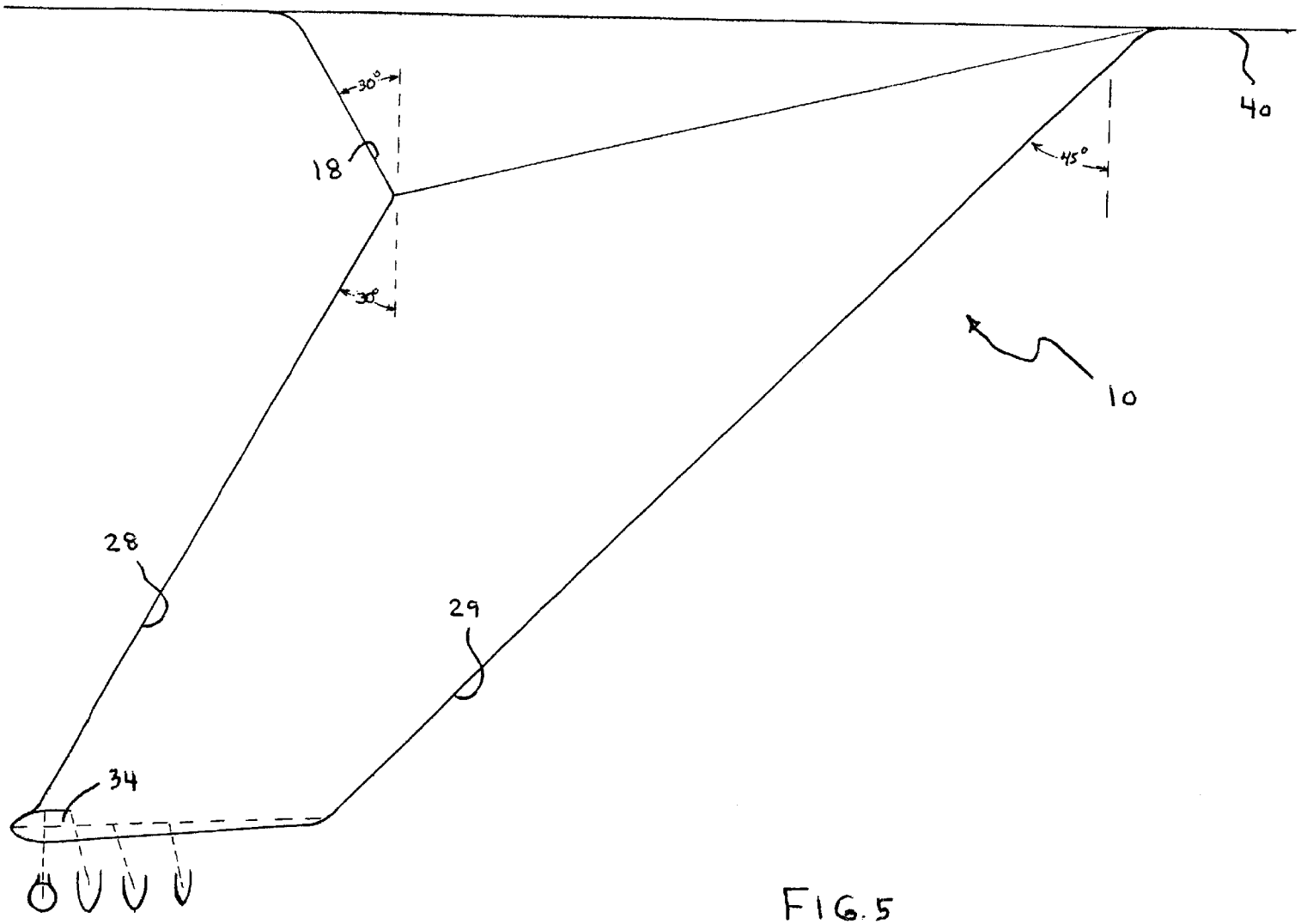
FIG. 5 is a schematic side elevation view of the windsurf (W.S.) version of the fin showing several cross-sectioned points of the bottom end to illustrate the narrower profile of this version (show as it would look when mounted). The bottom teardrop design of the W.S. version differs from the regular surfboard fin teardrop in that it is at no point wider than the tapered end of the fin body.

FIG. 2 is a schematic combination front and side view with 3 separate cross-sections that show the thickness at the top, at the location of the leading edge angle change, and near the bottom of the junction with the 'teardrop' shape. The purpose of these views are to show how the fin is thickest at the top and thinner towards the bottom. Production fins will vary in thickness according to the strength and rigidity of the material used. FIG. 3 is a top view sample F.C.S. attachment tabs. FIG. 4 is a schematic bottom perspective view of either a surf or windsurf board 42 having a bottom surface 40 with center mounted full-size fin (Not shown to scale). FIG. 4A is a schematic bottom perspective view of a surfboard with center mounted full-size fin and two scaled down "thruster' type versions of the fin mounted one on each side, outboard of the larger center fin; and FIG. 5 is a schematic side elevation view of the windsurf (W.S.) version of fin showing several cross-sectioned points of the bottom end to illustrate the narrower profile of this version (shown in as it would look when mounted). The bottom teardrop design of the W.S. version differs from the regular surfboard fin teardrop in that it is at no point wider than the tapered end of the fin body. While this version of the fin (W.S.) Can function well in either the windsurf or regular surfing applications, the larger "teardrop" of the surfboard fin design would be slightly less efficient if used in the windsurf application.

What is claimed is:

1. A bottom fin for a watersports board comprising:

an upper body portion having a front end, a rear end, a left side, a right side, a top edge and a bottom end; said top edge having a front end point A and a rear end point B; said top edge having a longitudinally extending X-axis; said front end having an upper body portion leading edge that extends downwardly and rearwardly to a front end point C at an acute angle P from a Y-axis extending vertically perpendicular to said X-axis at said front end point A; said rear end having an upper body portion trailing edge that extends downwardly and forwardly from said rear end point B to a rear end point D at an acute angle R to said X-axis; said bottom end of said upper body portion is defined by a line between said front end point C and said rear end point D;

a lower body portion having a front end, a rear end, a front side, a left side, a right side, a top end and a bottom edge; said top end of said lower body portion is defined by said line extending between said a front end point C and said rear end point D; said top end of said body portion being connected to said bottom end of said upper body portion; said front end having a lower body leading edge that extends downwardly and forwardly at an acute angle Q from said front point C to a front end point E located at the front end of said bottom edge of said lower body portion; said rear end having a lower body portion trailing edge that extends downwardly and forwardly from said rear end point D to said rear end point F at an acute angle R to said rear end of said bottom end of said lower body portion.

2. A bottom fin for a watersports board as recited in claim 1 wherein said upper body portion has a height H1 and said height of said lower body portion is H2 and H2 is at least twice as much as H1.

3. A bottom fin for a watersports board as recited in claim 1 wherein said upper body portion and said lower body portion are integrally formed as a single structure.

4. A bottom fin for a watersports board as recited in claim 1 further comprising attachment means on said top end of said upper body portion for attaching said bottom fin to the bottom surface of a watersports board.

5. A bottom fin for a watersports board as recited in claim 1 wherein said attachment means comprises at least two longitudinally spaced attachments lugs.

6. A bottom fin for a watersports board as recited in claim 1 wherein said upper body portion leading edge is substantially a straight line from front end point A to front end point C.

7. A bottom fin for a watersports board as recited in claim 1 wherein said lower body portion leading edge is substantially a straight line from front end point C to front end point E.

8. A bottom fin for a watersports board as recited in claim 1 wherein said trailing edge from rear end point B to rear end point F is substantially a straight line.

9. A bottom fin for a watersports board as recited in claim 1 wherein acute angle P is substantially equal to 30 degrees.

10. A bottom fin for a watersports board as recited in claim 1 wherein acute angle Q is substantially equal to 30 degrees.

11. A bottom fin for a watersports board as recited in claim 1 wherein acute angle R is substantially equal to 45 degrees.

12. A bottom fin for a watersports board as recited in claim 1 wherein said top edge of said upper body portion has a length L1 between front end point A and rear end point B and L1 is in the range of 4–12 inches long.

13. A bottom fin for a watersports board as recited in claim 1 further comprising an elongated bulbous member connected to said bottom end of said lower body portion from said front end point E to said rear end point F.

14. A bottom fin for a watersports board as recited in claim 13 wherein said bulbous member is teardrop-shaped.

15. A bottom fin for a watersports board as recited in claim 13 wherein said bulbous member has a longitudinally extending N-axis that slopes downward from rear to front at an acute angle.

16. A bottom fin for a watersports board as recited in claim 1 in combination with a surfboard.

17. A bottom fin for a watersports board as recited in claim 1 in combination with a windsurfer board.

* * * * *